United States Patent [19]

Komatsu et al.

[11] Patent Number: 4,677,427

[45] Date of Patent: Jun. 30, 1987

[54] DISPLAY CONTROL CIRCUIT

[75] Inventors: Shigeru Komatsu; Tetsuya Ikeda, both of Yokohama, Japan

[73] Assignee: Hitachi, Ltd., Tokyo, Japan

[21] Appl. No.: 651,153

[22] Filed: Sep. 17, 1984

[30] Foreign Application Priority Data

Sep. 16, 1983 [JP] Japan ..... 58-169156

[51] Int. Cl.[4] ..... G09G 1/16

[52] U.S. Cl. ..... 340/703; 340/750; 340/798

[58] Field of Search ..... 340/703, 747, 750, 721, 340/798, 799, 801

[56] References Cited

U.S. PATENT DOCUMENTS 4,016,544 4/1977 Morita et al. ..... 340/703

4,352,105 9/1982 Harney ..... 340/703

4,509,043 4/1985 Mossaides ..... 340/703

*Primary Examiner*—Marshall M. Curtis

*Attorney, Agent, or Firm*—Antonelli, Terry & Wands

[57] ABSTRACT

There is provided a display control circuit including a central processing unit and display memory elements provided corresponding to respective data lines of the central processing unit. The display memory elements respectively have a plurality of data input terminals supplied with bit orders beforehand. As the display memory element, a large capacity readable/writable memory having a bit width per address such as 4 or 8 is used.

Each bit per one address of said display memory element is assigned to an element belonging to each plane in the depth direction which constituted an individual picture element on the display screen. And one picture element is represented by one address of one display memory element. As a result, the number of display memory elements can be decreased.

2 Claims, 5 Drawing Figures

DISPLAY CONTROL CIRCUIT

BACKGROUND OF THE INVENTION

1. Field of the Invention

The present invention relates to an image display unit capable of displaying a color image with a high resolution and in particular to a display control circuit which is suitable for writing data into a display memory in dot-by-dot coloring.

2. Description of the Prior Art

As an apparatus for reading out data written in a display memory of a personal computer, for example, and graphically displaying the data on a display screen such as a CRT, higher resolution of color display is required and it is necessary to color picture cells dot by dot. Thus, a display memory having a very large capacity is necessitated. Therefore, writing data into the display memory by using only software often results in an insufficient display speed. In the so-called bit map system which is most widely used at the present time, one bit of data corresponds to one dot on the display screen. For writing only one dot with a designated color into the memory in such a bit map system, the following steps must be executed for each of a plurality of display memories.

(1) The color data already stored at an address at which new data is to be stored is read into a CPU register.

(2) The color data thus read out is ORed with the data to be written.

(3) The resultant ORed data is stored in the address.

Such processing which requires a long time, provided that software is used alone, can be executed in a short time by adding a suitable circuit. Such an additional circuit is described in U.S. application Ser. No. 488757 previously filed by the inventors of the present application, for example.

The above described bit map system will now be described by referring to the drawings. FIG. 1 is a block diagram of an example of a prior art display memory unit using the above described bit map system. In FIG. 1, numeral 1 denotes a CPU (Central Processing Unit), numeral 2 denotes an address bus, numeral 3 denotes a data bus, numeral 4 denotes a read/write selection signal line, and numeral 5 denotes an address decoder. Numerals 6, 7 and 8 denote display memories for three principal colors, i.e., red, green and blue (hereafter abbreviated as R, G and B, respectively). Numeral 9 denotes a display memory for intensity (hereafter abbreviated as I). A data gate circuit 10 constitutes a memory control means and gates data from the data bus 3 under the control of a display memory selection signal 11 fed from the address decoder 5. A data bit selection signal 12 fed from the data gate circuit 10 selects respective memory chips of each of the display memories 6, 7, 8 and 9. Color registers 13, 14, 15 and 16 constitute data supply means for directing write data into the display memories 6, 7, 8 and 9, respectively. Output signals of these color registers are fed to data input terminals of the respective associated display memories.

In the display memory unit shown in FIG. 1, the data gate circuit 10 selects one or more memory chips in each display memory for each data bit to be written into the display memories 6, 7, 8 and 9. It gates the data on the data bus 3 in response to the display memory selection signal 11 and supplies the output signal to the display memories 6, 7, 8 and 9 as the bit selection signal for the respective memory chips of the display memories. The color registers 13, 14, 15 and 16 store color information of the graphic patterns for instructing whether or not the graphic data to be displayed is to be written into the display memories 6, 7, 8 and 9 for three principal colors and intensity. Since one bit is stored in each of the color registers 13, 14, 15 and 16, four bits in total are stored in these registers. The color information is written into the color registers 13, 14, and 15 from the data bus. That is to say, color codes corresponding to R, G, and B may be directly written into the color registers 13, 14 and 15, respectively.

FIG. 2 shows a circuit diagram to illustrate the connection of the display memory 6, the data gate circuit 10 and the color register 13 as shown in FIG. 1. The peripheral circuits of the display memories 7, 8 and 9 are also connected in the same manner. In FIG. 2, the data gate circuit 10 comprises eight AND circuits and it supplies the data on the data bus 3 to the memory chips of the display memories 6, 7, 8 and 9 as memory chip selection signal 12 at the time of receipt of the display memory selection signal 11 from the output of the address decoder 5. The color register is a one-bit latch and the output signal thereof is supplied to the display memory 6 as the data entry signal to the display memory 6.

Four display memories 6, 7, 8 and 9 are provided. Each of the four display memories comprises as many memory chips as data lines on the data bus 3. That is to say, only one bit of data per address can be stored in one memory chip.

The writing of the data into the display memory in the display memory unit shown in FIGS. 1 and 2 is now explained. The CPU 1 designates the colors of the graphic pattern to be displayed by four bits, one for each of R, G, B and I, and the color information is stored in the color registers 13, 14, 15 and 16.

The writing of the data into the color registers 13, 14, 15 and 16 is performed via the data bus 3. In one example, bit 0 on the data bus 3 corresponds to R, and bits 1, 2 and 3 correspond to G, B and I, respectively.

The brightness information for controlling whether or not new color information is written to be displayed is then written at the address of each of the display memories 6, 7, 8 and 9 corresponding to the address on the display screen. The address of each of the display memories 6, 7, 8 and 9 is provided on the address bus 2 and the address decoder 5 produces the display memory selection signal 11 upon detection of an address on bus 2 which falls within the range of addresses allotted to the display memories 6 to 9; so that the data gate circuit 10 is opened. On the other hand, the brightness information to be written into the display memory is provided on the data bus 3, and this data is supplied to the display memories 6, 7, 8 and 9 through the data gate circuit 10 as the memory chip selection signal 12.

The signal 12 controls the selective writing of data into each chip of the display memory 6. Since the chip selection signal 12 is obtained by inverting the pattern data, only the bits having pattern data "1" are selected to be written, and the bits having pattern data "0" are not selected to be written. As a result, the writing of the color information of the color register 13 is permitted for the chip of the display memory to which the "1" brightness information data is supplied, and the writing of the data is not permitted for the chip of the display memory to which the "0" data is supplied. That is to say, the writing of data is controlled depending upon whether the brightness information data is "1" or not. Accordingly, when the new data is overwritten on the recorded data at the same address of the display memory, the software processing of writing the ORed data of the recorded data and the new data as is done in the prior art unit is not necessary, but only the data to be newly written need to be written into the display memory. The color data stored in the above described color register is written only for the data bits newly written, that is, the bits to which "1" information are supplied, and the data remains unchanged for those bits which have been previously recorded. Therefore, the bit map system raises the display speed. As evident from FIG. 2, however, it must be possible to control the enable/disable condition of each bit of the display memory in the bit map system. Accordingly, memory chips having one bit per address had to be used in parallel. In this case, the number of required elements is usually equal to the number of the data bus lines of the CPU (number of bits of data outputted by the CPU); multiplied by the number of colors, i.e., the number of planes in the depth direction of the display screen. For example, in a system having an 8-bit CPU and the above described display memories for R, G, B and I, 32 ($=8\times4$) memory chips for the display memories are required. For a display screen having 640 dots in the horizontal direction and 200 dots in the vertical direction, which is the most common display screen in th current personal computer, the necessary total capacity of display memories for R, G, B and I is 512,000 ($=640\times200\times4$) bits. This capacity can be obtained by using eight 64-kbit dynamic RAM's as the memory chips for each display memory;. However, in the disclosed system 32 memory chips must be used because each bit of the display memory must be controlled to be in the enable/disable condition. This results in problems including the increased cost, enlarged board size, and increased unnecessary area on the display memory.

SUMMARY OF THE INVENTION

An object of the present invention is to obviate increase in the number of display memory elements which is a drawback without hampering the high speed display function which is a feature and to provide a display control circuit which can be formed by using a smaller number of display memory elements.

In order to achieve the above described object, in accordance with the present invention, a readable/writable memory of a large capacity having a bit width per address such as 4 or 8, is used as the display memory element. Each bit is assigned to an element belonging to each plane in the depth direction which constitutes an individual picture element on the display screen. And one picture element is represented by one address of one display memory element to reduce the number of display memory elements.

BRIEF DESCRIPTION OF THE DRAWINGS

The present invention will be apparent from the following detailed descriptions in conjunction with the accompanying drawings, in which.

DESCRIPTION OF THE PREFERRED EMBODIMENTS

Figure 1:
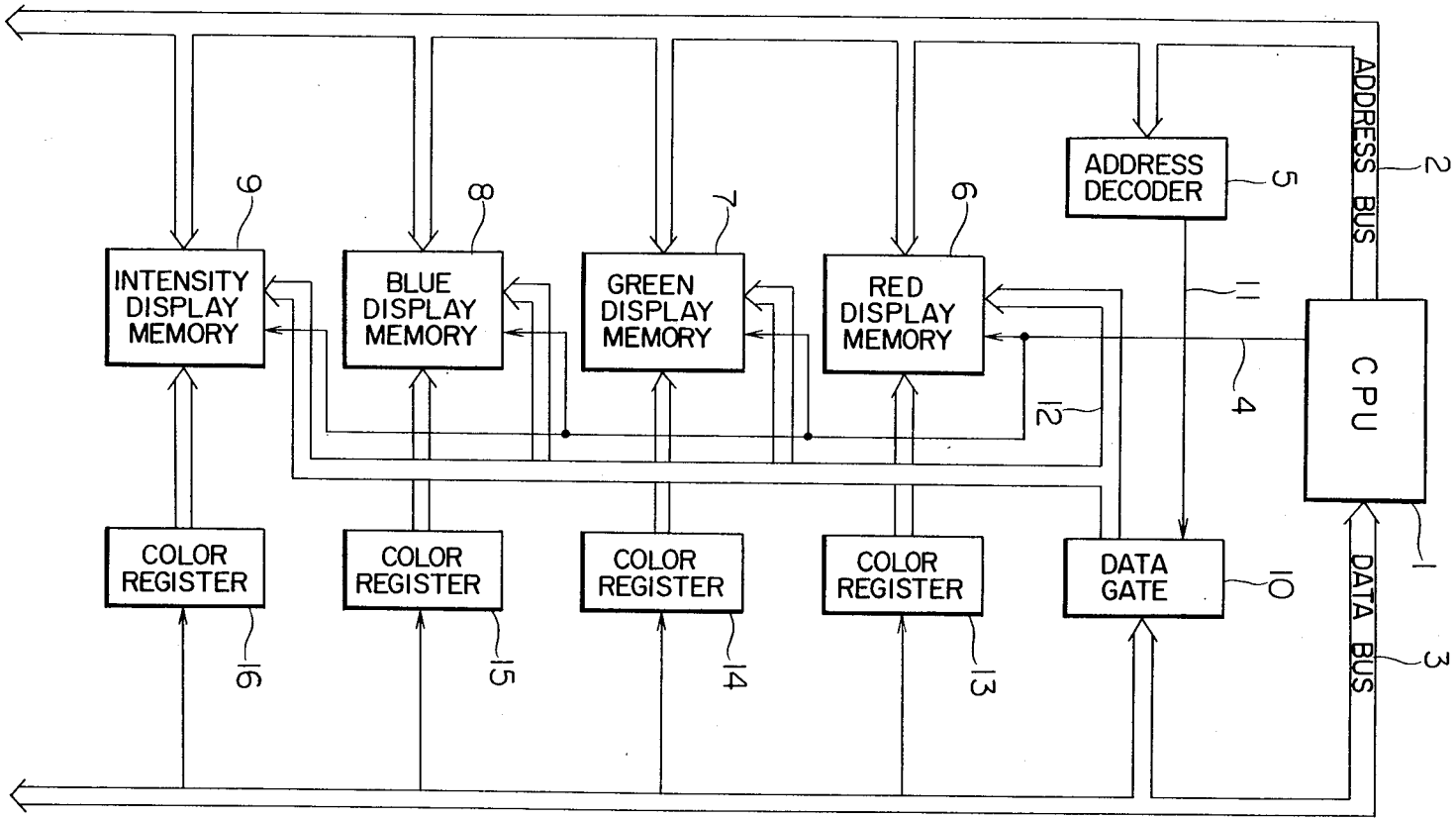
FIG. 1 PRIOR ART
FIG. 1 is a block diagram of a prior art display control circuit.
Figure 2:
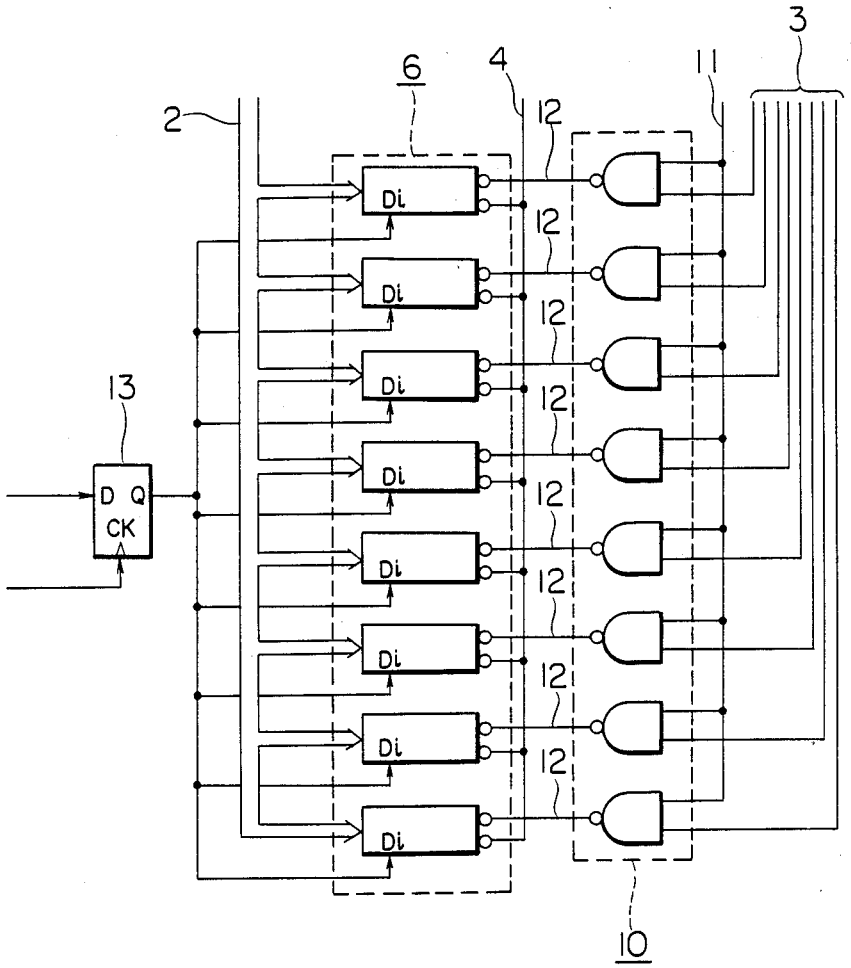
FIG. 2 PRIOR ART
FIG. 2 is a detailed block diagram of a principal part of FIG. 1.
Figure 3:
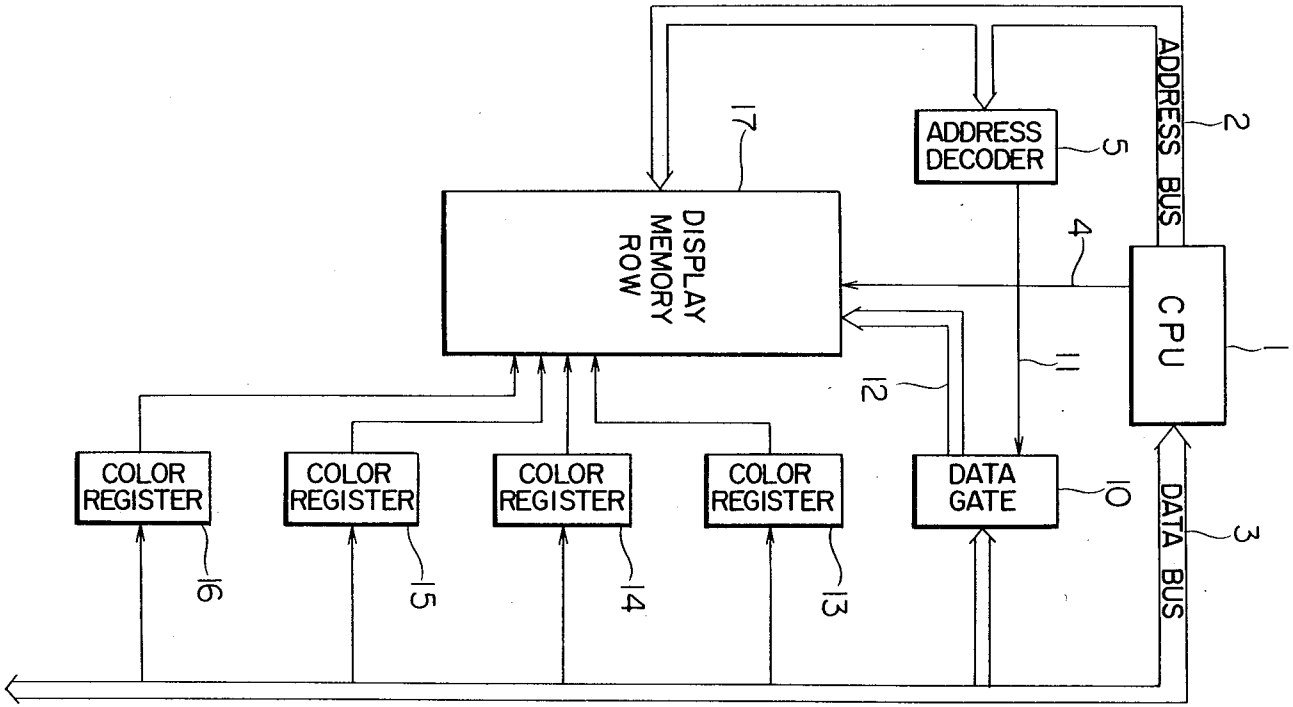
FIG. 3 is a block diagram of one embodiment of a display control circuit of the present invention.
Figure 4:
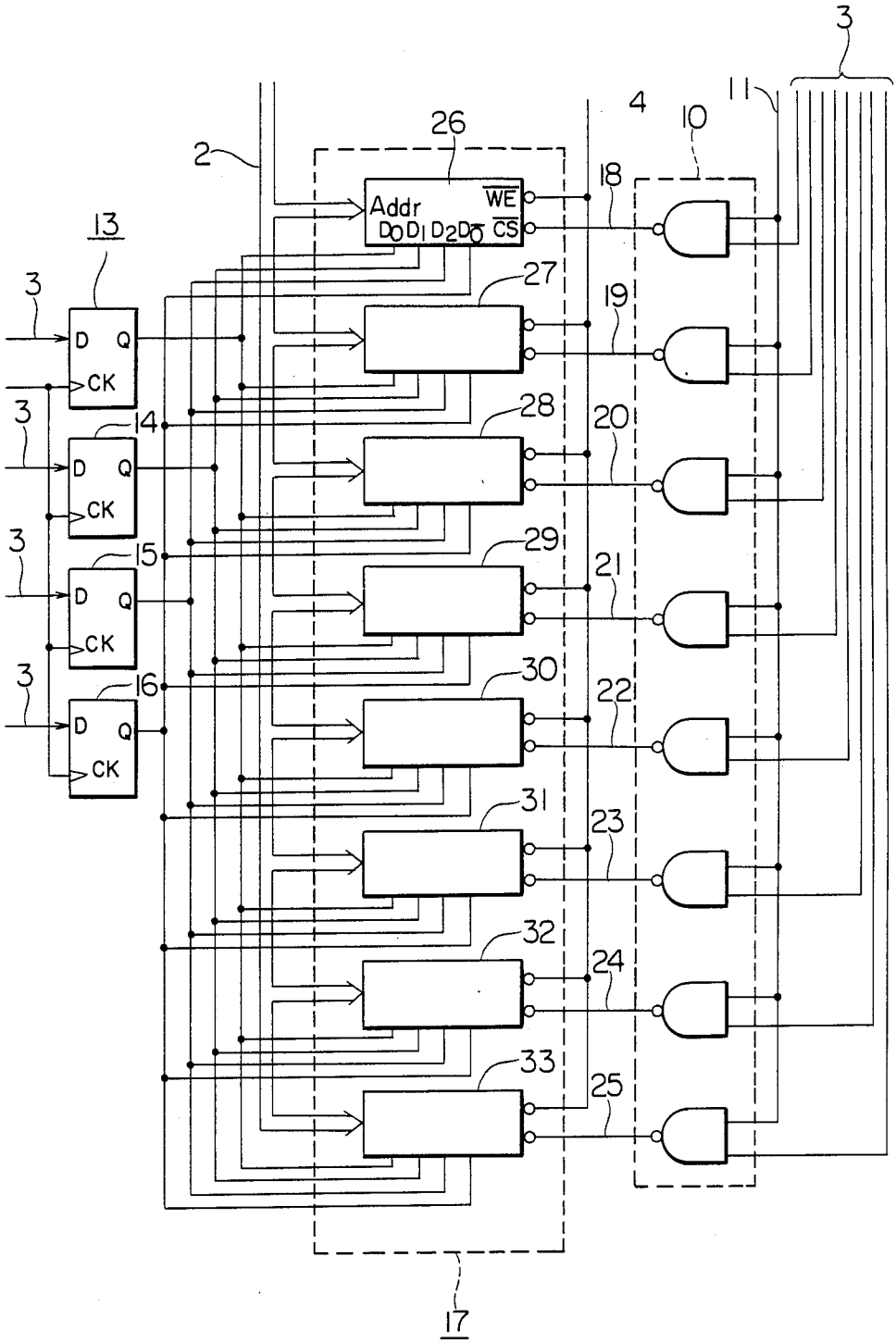
FIG. 4 is a detailed block diagram of a principal part of FIG. 3.

One embodiment of the present invention will now be described by referring to FIGS. 3, 4 and 5. FIG. 3 shows the schematic configuration of the present embodiment. Reference numerals 1 to 16 in FIG. 3 designate elements similar to those of the prior art unit shown in FIG. 1. Reference numeral 17 denotes a display memory row. There is basically little difference between the display control circuit shown in FIG. 3 and the prior art unit shown in FIG. 1. FIG. 4 shows the detailed construction of the display memory row 17, the data gate circuit 10, color registers 13 to 16, and their peripheral circuit. In FIG. 4, reference numerals 18 to 25 denote memory chip selection signals constituting write control input signals and reference numerals 26 to 33 denote display memory elements. Other elements identified by like numerals to those of FIG. 3 have like designations and functions. In FIG. 4, the 8-bit data bus 3 is coupled to the data gate circuit 10 comprising eight AND gates. The display memory selection signal 11 is applied to the other inputs of the AND gates. The above described memory chip selection signals 18 to 25 are fed from the outputs of the AND gates. The memory chip selection signals are supplied to chip select terminals CS's of the display memory elements 26 to 33. Each of display memory elements 26 to 33 is a dynamic memory having a bit width of 4 and 16384 addresses, such as Model TMS 4416 produced by Texas Instruments. The 1-bit data stored in the color register 13 is fed to the first bit data input/output terminals of the display memory elements 26 to 33. The 1-bit data stored in the color register 14 is fed to the second bit data input/output terminals of the display memory elements 26 to 33. The 1-bit data stored in the color register 15 is fed to the third bit data input/output terminals of the display memory elements 26 to 33. The 1-bit data stored in the color register 16 is fed to the fourth bit data input/output terminals of the display memory elements 26 to 33. And the address bus 2 is also connected to all of eight display memory elements 26 to 33 in parallel.

The operation principle of the embodiment of the present invention will now be described in more detail by referring to FIG. 4. Referring to the conceptive drawing of the display circuit of FIG. 5, the CPU 1 colors a designated picture element P with a designated color C in the display unit DP by following steps below.

(1) Color C is converted into four bits of color data. The four bits are turn stored into color registers 13 to 16.

(2) The address A and bit number B in the display memory row 17, which correspond to the picture element P, are calculated.

(3) Binary data having bit "1" at the bit number B and bits "0" at the remaining bit positions are written at the address A.

In the step (1) described above, the color registers 13 to 16 correspond to three primary colors, i.e., red, green and blue, and intensity (such as bright red or half bright red), respectively. For example, a binary number "0001" stored in color registers 13 to 16 represents the red color. A binary number "1011" represents the highly bright yellow color. This color is held as it is until another color is set.

Let's assume now that binary number data "00000001" in which only the least significant bit is "1" are written at the address A in the step (3). When the address A is generated, the display memory selection signal 11 is enabled. Only the AND gate associated with the least significant bit then enables its output, i.e., the memory chip selection signal 18 responsive to the state "1" fed from the data bus 3. At this time, the data input terminals $D_0$ to $D_3$ of the display memory element 26 are supplied with the outputs of the color registers 13 to 16, respectively. And the read/write selection signal 4 represents the write mode, and the address bus 2 designates the address A. Accordingly, the 4-bit data stored in the color registers 13 to 16 are written at the address A of the display memory element 26. Since all of the memory chip selection signals 19 to 25 are inhibited, the display memory elements 27 to 33 continue to hold the data which have been held until then. Accordingly, as explained above in connection with the prior art, when the new data is overwritten on the recorded data at the same address of the display memory, the processing composed of reading every time the display data already written and writing the ORed data of the recorded data and the new data is not necessary. As a result, high speed display becomes possible. Heretofore, the processing for writing one dot at one address has been described. However, it is also possible to write two or more dots with the same color at one address, if desired, by setting a plurality of bits on the data bus 3 to "1".

For a color display circuit capable of simultaneously displaying 16 colors on one picture element and capable of displaying an image on the screen having 640 dots in the horizontal direction and 200 dots in the vertical direction, 32 display memory elements respectively storing one bit per address are required in case of the prior art. Meanwhile, only eight display memory elements are required in case of the present embodiment. That is to say, the number of display memory elements has been reduced to one fourth.

Figure 5:
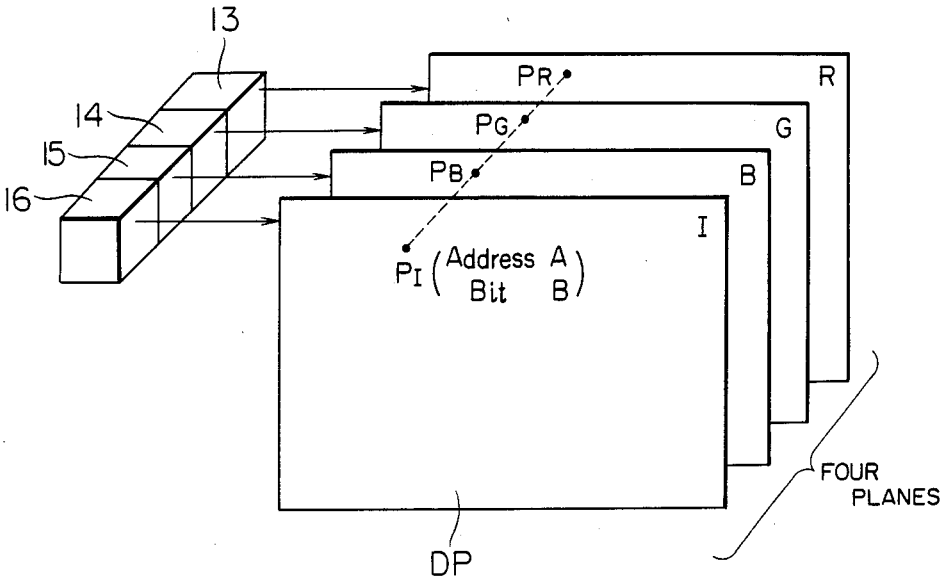
FIG. 5 shows a conceptive drawing of a display circuit for explaining the present invention.

In the above described embodiment, four planes are provided in the depth direction to simultaneously display 16 ($=2^4$) colors as illustrated in the conceptive drawing of the display circuit of FIG. 5. As readily imagined, eight planes can be provided in the depth direction to simultaneously display 256 ($=2^8$) colors provided that the display memory row 17 is composed of eight display memory elements respectively storing 8 bits per address and that eight color registers are used. In this case, whereas the prior art necessitates 64 display memories, the present invention necessitates 8 display memories.

Owing to the present invention, the number of display memory elements can be reduced to one fourth in the most common case without in the least lowering the high speed displaying feature which is a merit of the prior art. This results in excellent effects such as reduction in size and cost of products. A dynamic memory which is now the most readily available and the most inexpensive is a 64-kbit memory. If a dynamic memory having a structure of 1 bit×64K is used as the display memory, the actually required address area occupies 8K to 32K words in most cases and hence the remaining addresses of 48K to 32K words are often left unused. If the structure of 4 bits×16K is used, the useless address area usually does not exceed 8K words, the utilization coefficient of the display memory being significantly improved.

We claim:

1. A display control circuit comprising:

a central processing unit having a plurality of data lines;

a plurality of display memory elements provided in a number corresponding to the number of respective data lines of said central processing unit, said plurality of display memory elements each having a plurality of addressable storage locations, each storage location being capable of storing plural bits, and each having a plurality of data inputs for supplying the plural data bits to be stored at an addressable storage location;

a plurality of data supply means each connected to said data lines and a respective data input of each of said display memory elements for supplying data to said display memory elements so that the same data may be supplied to data input terminals for the same bit order in all display memory elements; and memory control means connected to said data lines for setting said plurality of display memory elements into enable/disable states independently of each other by selectively supplying write control signals to respective display memory elements, whereby said plurality of bits from said plurality of data supply means are written into those display memory elements which are selectively enabled by said memory control means.

2. A display control circuit according to claim 1, wherein one picture element is represented by one addressable storage location of one of said display memory elements.

* * * * *